US007074017B2

(12) United States Patent
Coray et al.

(10) Patent No.: US 7,074,017 B2
(45) Date of Patent: Jul. 11, 2006

(54) QUICK-RELEASE PUMP MODULE

(76) Inventors: Dale E. Coray, 106 Okotoks Road, Malahat, British Columbia (CA) V0R 2L0; Richard M. McGahee, 2651 W. Carnino De La Joya, Tucson, AZ (US) 85742

( * ) Notice: Subject to any disclaimer, the term of this patent is extended or adjusted under 35 U.S.C. 154(b) by 0 days.

(21) Appl. No.: 10/969,535

(22) Filed: Oct. 20, 2004

(65) Prior Publication Data

US 2005/0084401 A1 Apr. 21, 2005

Related U.S. Application Data

(60) Provisional application No. 60/512,791, filed on Oct. 20, 2003.

(51) Int. Cl.
*F04B 17/00* (2006.01)
*B23P 6/00* (2006.01)

(52) U.S. Cl. ..... 417/360; 29/888.021

(58) Field of Classification Search ..... 417/53, 417/360, 572, 214; 415/131, 132; 29/888.021, 29/221.6, 239, 426.1
See application file for complete search history.

(56) References Cited

U.S. PATENT DOCUMENTS

| | | | | | |
|---|---|---|---|---|---|
| 860,668 | A * | 7/1907 | Jaeger | 415/132 |
| 1,848,393 | A * | 3/1932 | Spielman | 417/360 |
| 3,088,416 | A * | 5/1963 | Danis | 415/132 |
| 5,344,291 | A * | 9/1994 | Antkowiak | 417/359 |
| 5,441,358 | A * | 8/1995 | King | 403/30 |
| 6,036,452 | A * | 3/2000 | Huang | 417/360 |
| 6,168,393 | B1 * | 1/2001 | Huber et al. | 417/360 |
| 6,461,115 | B1 * | 10/2002 | Ferrier et al. | 417/53 |
| RE37,995 | E * | 2/2003 | Barrus et al. | 417/410.3 |

* cited by examiner

*Primary Examiner*—Charles G. Freay
(74) *Attorney, Agent, or Firm*—Antonio R. Durando

(57) ABSTRACT

A slurry pump includes a power frame as well as a wet end, and the wet end comprises a casing, an impeller and wear ring in the casing, a stub shaft connected to the impeller, a sleeve assembly for the stub shaft and an adapter for adjusting the wet end to the power frame. The wet end can be attached to and detached from the power frame as a module.

23 Claims, 10 Drawing Sheets

QUICK-RELEASE PUMP MODULE

REFERENCE TO RELATED APPLICATION

This application is based on provisional application Ser. No. 60/512,791 filed 20 Oct. 2003 by Dale E. Coray and Richard M. McGahee for "A Quick-Release Pump Module."

BACKGROUND OF THE INVENTION

1. Field of the Invention

The invention relates to a pump.

2. Description of the Prior Art

Slurry pumps typically include a power frame as well as a so-called wet end which is attached to the power frame. The power frame comprises a bearing assembly, and a drive shaft which is rotatably supported by the bearing assembly and is connected to a motor. The wet end, on the other hand, comprises a sealed casing which houses an impeller and is formed with a suction port and a discharge port. The impeller is mounted on a stub shaft which receives power from the drive shaft.

When the wet end requires maintenance, the major components of the wet end are disconnected from the power frame individually and in the reverse order from which such components were assembled with the power frame. Removal of the wet end from the power frame and reassembly of the wet end therewith are time-consuming procedures which can take as long as 12 hours and result in considerable downtime.

SUMMARY OF THE INVENTION

One aspect of the invention resides in a pump. The pump comprises a drive section and a driven section, and the drive section includes a support and a drive member mounted on the support. The driven section includes a housing as well as a pumping member which is located in the housing and is arranged to be driven by the drive member. The driven section is attachable to and detachable from the drive section as a module.

Aside from the housing and the driven pumping member, the driven section may include another driven member which is arranged to be coupled to the drive member and the pumping member.

The pump can further comprise a transmitting member for transferring force from the drive section to the driven section. Under these circumstances, the transmitting member and the drive section are provided with cooperating first coupling elements for establishing a drive connection between the transmitting member and the drive section. Similarly, the transmitting member and the driven section are provided with cooperating second coupling elements for establishing a drive connection between the transmitting member and the driven section.

The driven section and the transmitting member may also be provided with cooperating alignment elements for aligning the driven section and the transmitting member.

The pump can additionally comprise an arresting member for arresting the pumping member. The arresting member, which is preferably discrete from the drive section and the driven section, may be insertable in and removable from the driven section. The arresting member and the driven section are then advantageously provided with means for securing the arresting member to the driven section.

The housing for the pumping member generally has a fluid inlet and a fluid outlet and the arresting member can be designed for insertion in one of the inlet and the outlet so as to arrest the pumping member.

Another aspect of the invention resides in a member for transmitting force from a drive section to a driven section of a pump. The transmitting member comprises a carrier having two surface portions, and first coupling means on one of the surface portions for establishing a drive connection between the carrier and the drive section of the pump. The other of the surface portions is provided with second coupling means for establishing a drive connection between the carrier and the driven section of the pump.

The transmitting member may further comprise an alignment element on the surface portion with the second coupling means for the purpose of aligning the carrier and the driven section of the pump. This alignment element is advantageously constituted by a tapered pin.

The carrier, which is preferably in the form of a circular disk, can be provided with openings for connecting elements designed to connect the drive section of the pump and the driven section of the pump with one another.

An additional aspect of the invention resides in a method of handling a pump having a drive section and a driven section. The driven section, which is attached to the drive section, includes a housing as well as a pumping member in the housing arranged to be driven by the drive section. The method comprises the step of detaching the driven section from the drive section as a module.

The method may further comprise the step of arresting the pumping member, and the arresting step can involve insertion of an arresting member in the driven section. If an arresting member is inserted in the driven section, the method may comprise another step of securing the arresting member to the driven section.

The housing for the pumping member is normally provided with a fluid inlet and a fluid outlet, and the arresting step may here include inserting the arresting member in one of the inlet and the outlet.

The method can also comprise the step of reattaching the driven section to the drive section as a module. The reattaching step may involve interposing a force-transmitting member between the drive section and the driven section, and establishing a drive connection between the drive section and the driven section through the force-transmitting member.

Additional features and advantages of the invention will be forthcoming from the following detailed description of preferred embodiments when read in conjunction with the accompanying drawings.

DESCRIPTION OF THE PREFERRED EMBODIMENTS

Figure 1:
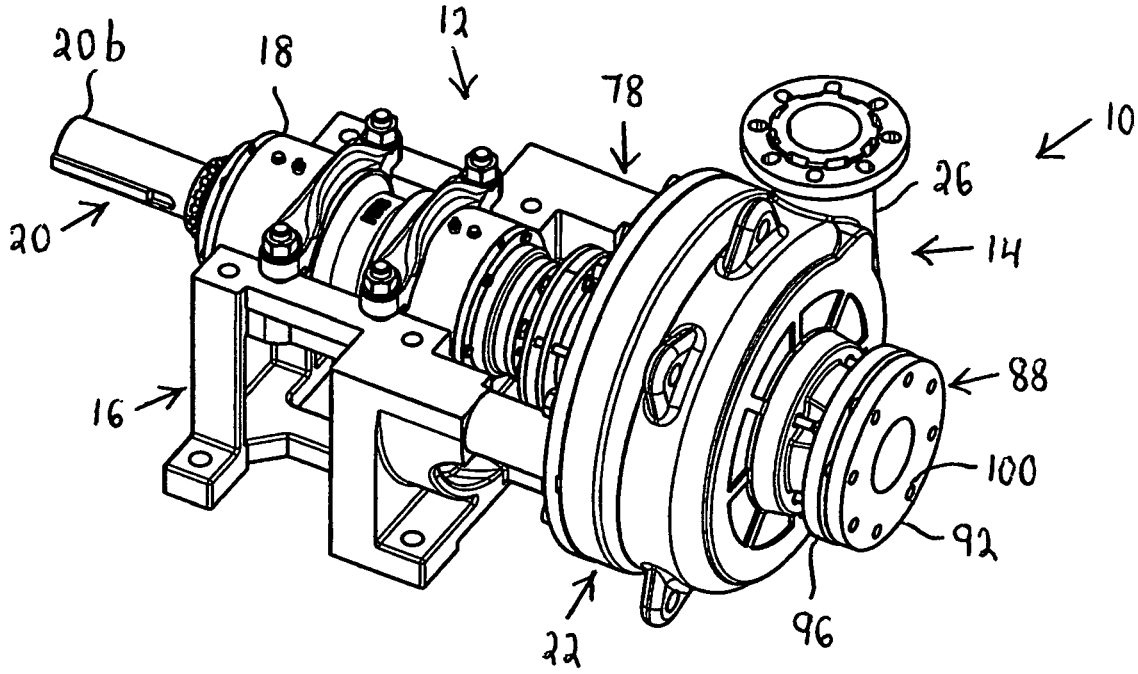
FIG. 1 is a perspective view of a pump constructed according to the invention and having a power frame as well as a wet end.

Referring to FIG. 1, the numeral 10 identifies a pump in accordance with the invention. The pump 10, which is here assumed to be a slurry pump for a mining or other industrial facility, includes a power frame or drive section 12 and a wet end or driven section 14 attached to the frame 12.

Figure 2:
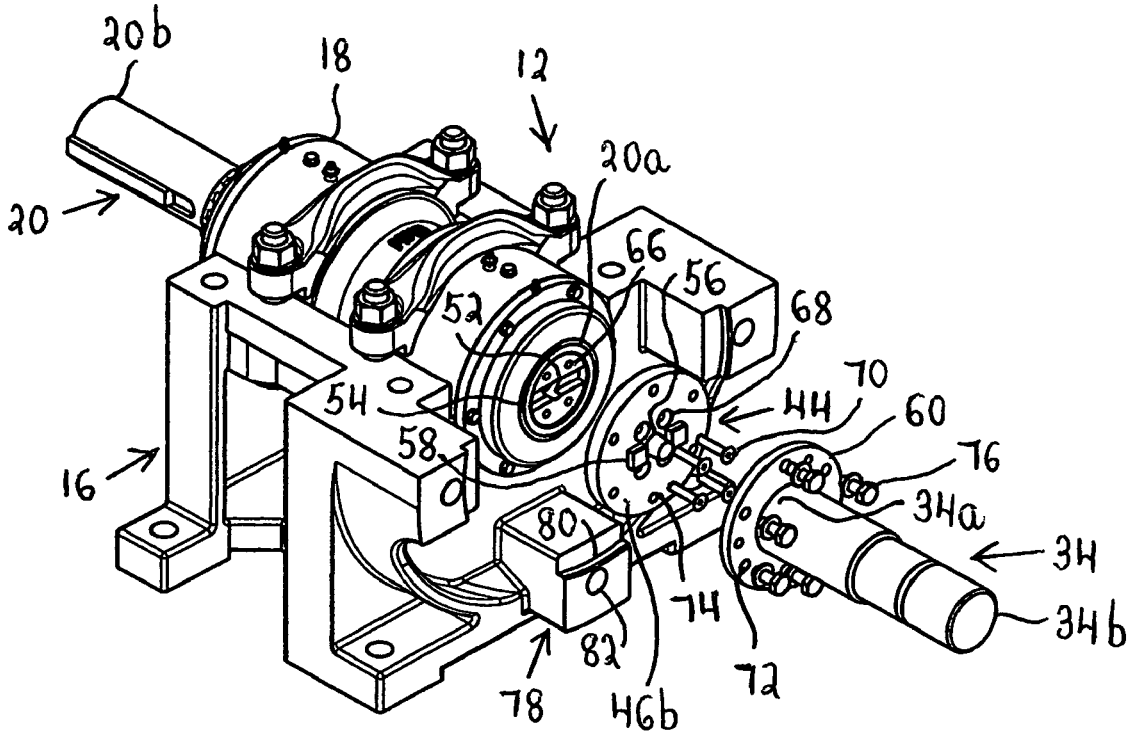
FIG. 2 is a partially exploded perspective view, as seen from the wet end, of the power frame, a stub shaft forming part of the wet end and a connector for coupling the wet end to the power frame.

Considering FIG. 2 together with FIG. 1, the power frame 12 includes a pedestal or support 16 which carries a bearing assembly 18. A receiver shaft or drive member 20 is mounted for rotation in the bearing assembly 18, and the receiver shaft 20 has a drive end 20*a* which adjoins the wet end 14 and a driven end 20*b* which is remote from the wet end 14. The driven end 20*b* is adapted to be coupled to a non-illustrated motor.

For ease of bearing replacement, the drive end 20*a* of the receiver shaft 20 is located adjacent to the flinger which adjoins the wet end 14.

Figure 3:
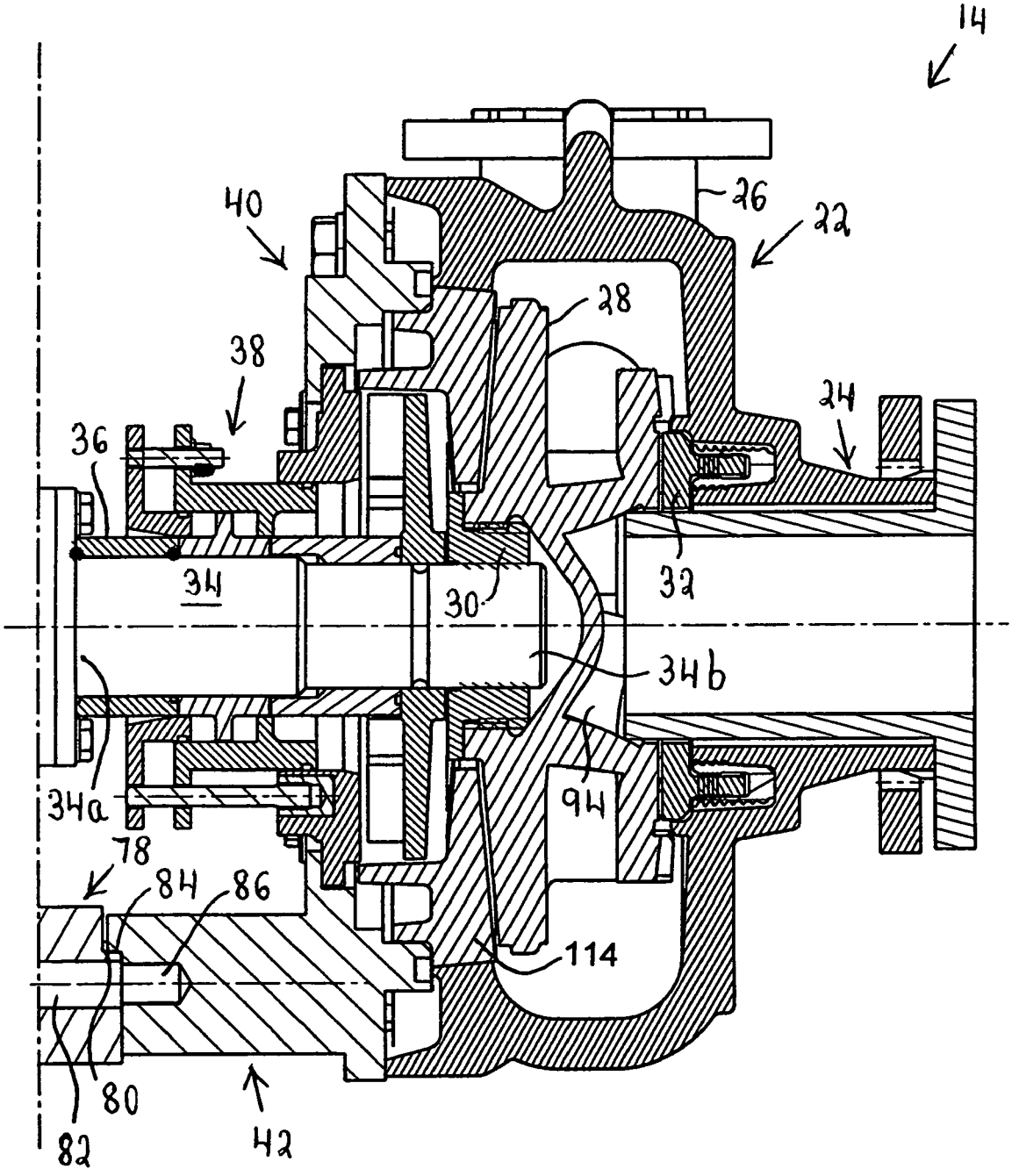
FIG. 3 is a longitudinal sectional view of the wet end.
Figure 4:
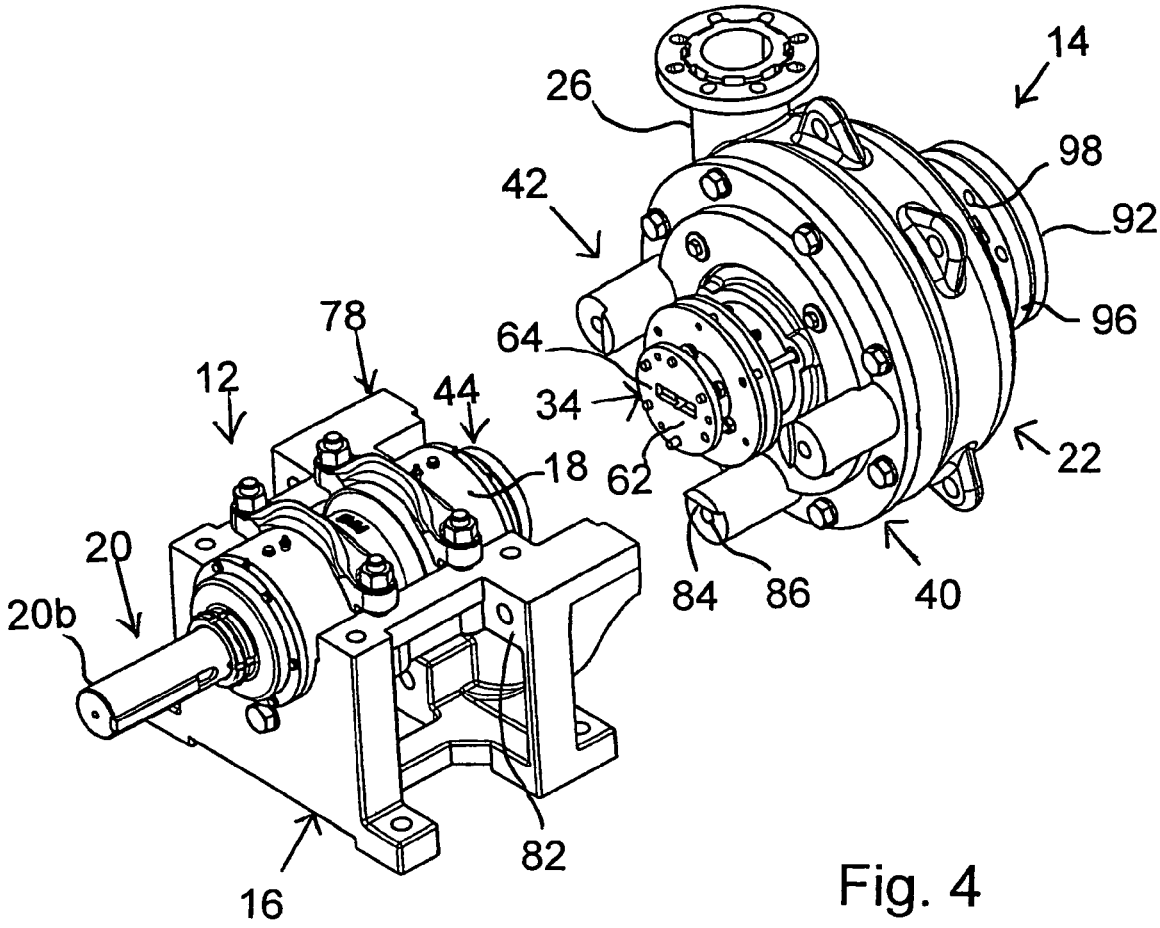
FIG. 4 is a perspective view showing the power frame and wet end separated.

With regard to FIGS. 1, 3 and 4, the wet end 14 comprises a casing or housing 22 having a suction or intake port 24 and a discharge or output port 26. The suction port 24 constitutes a fluid inlet for the casing 22 whereas the discharge port 26 constitutes a fluid outlet for the casing 22.

An impeller or pumping member 28 is mounted for rotation internally of the casing 22. The impeller 28, which is coaxial with the suction port 24, is keyed to an internally threaded sleeve 30 which is coaxial with the impeller 28. A wear ring 32 located at the inner end of the suction port 24 confronts the impeller 28 and is spaced from the latter by a predetermined clearance. The clearance between the impeller 28 and the wear ring 32 is adjustable.

The impeller 28 is rotated by a stub shaft or driven member 34 having a driven end 34*a* and a drive end 34*b*. The drive end 34*b* of the stub shaft 34 is externally threaded and is designed to screw into the internally threaded sleeve 30 keyed to the impeller 28. The stub shaft 34, which is coaxial with the impeller 28, is rotatable in a shaft sleeve assembly 36 mounted inside a packing or stuffing box 38 fixed to the casing 22. The packing box 38 is coaxial with the suction port 24, and the packing box 38 and suction port 24 are located at opposite sides of the wet end 14.

The wet end 14 further comprises an adapter 40 which is coaxial with and circumscribes the packing box 38. The adapter 40 is provided with three legs or posts 42 of circular cross section, and the legs 42 project from the adapter 40 parallel to the axis of the stub shaft 34 in a direction away from the suction port 24.

The wet end 14 constitutes a module thereby enabling the casing 22, the impeller 28, the wear ring 32, the stub shaft 34, the sleeve 36 and the adapter 40 to be attached to and detached from the power frame 12 as a module.

Figure 5:
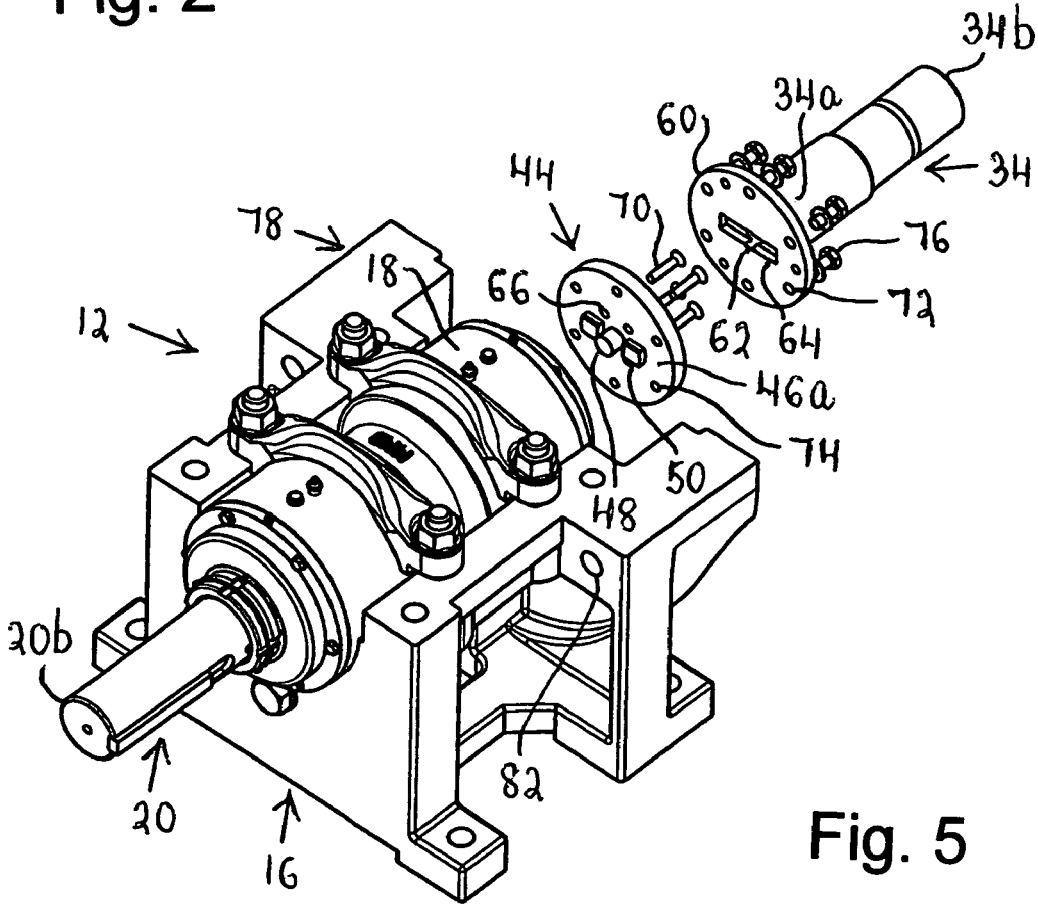
FIG. 5 is a view similar to that of FIG. 2 as seen from the power frame.

Turning to FIG. 5 in conjunction with FIG. 2, the pump 10 is equipped with a connector or force-transmitting member 44 which is interposed between the receiver shaft 20 and the stub shaft 34. The connector 44 includes a flat circular disk having major surfaces or surface portions 46*a* and 46*b* which face in opposite directions. The disk surface 46*a* is adapted to face the drive end 20*a* of the receiver shaft 20 while the disk surface 46*b* is adapted to face the driven end 34*a* of the stub shaft 34.

The disk surface 46*a* is provided with a preferably straight pin or other alignment element 48 which is centered on the disk surface 46*a* and projects from the disk surface 46*a* perpendicular thereto. The disk surface 46*a* further has two keys or coupling elements 50 located on diametrically opposite sides of the straight pin 48. The drive end 20*a* of the receiver shaft 20 has a surface which is arranged to face the disk surface 46*a*, and the straight pin 48 is receivable in a straight bore or alignment element 52 formed centrally of this surface of the receiver shaft 20. Such surface of the receiver shaft 20 is additionally provided with a keyway or coupling element 54 which is designed to receive the keys 50 on the disk surface 46*a*.

Similarly to the disk surface 46*a*, the disk surface 46*b* is formed with a preferably tapered pin or other alignment element 56 which is centered on the disk surface 46*b* and projects from the disk surface 46*b* perpendicular thereto. The disk surface 46*b* further has two keys or coupling elements 58 located on diametrically opposite sides of the tapered pin 56. The driven end 34*a* of the stub shaft 34 is provided with a flange 60 having a surface adapted to face the disk surface 46*b*, and the tapered pin 56 is receivable in a tapered bore or alignment element 62 formed centrally of this flange surface. Such flange surface is additionally provided with a keyway or coupling element 64 which is designed to receive the keys 58 on the disk surface 46*b*.

The straight pin 48 on the connector 44 and the straight bore 52 in the receiver shaft 20 facilitate alignment of the connector 44 and the receiver shaft 20 while the tapered pin 56 on the connector 44 and the tapered bore 62 in the stub shaft 34 facilitate alignment of the connector 44 and the stub shaft 34. On the other hand, the keys 50 on the connector 44 and the keyway 54 in the receiver shaft 20 function to transfer power or torque from the receiver shaft 20 to the connector 44 whereas the keys 58 on the connector 44 and the keyway 64 in the stub shaft 34 function to transfer power or torque from the connector 44 to the stub shaft 34.

The surface of the receiver shaft 20 with the keyway 54 is formed with four threaded holes 66 near the center of such surface. The connector 44 is provided with four holes 68 which are arranged to register with respective ones of the holes 66 when the straight pin 48 of the connector 44 is received in the straight bore 52 of the receiver shaft 20 and the keys 50 of the connector 44 are received in the keyway 54 of the receiver shaft 20. The holes 68 in the connector 44 extend from the disk surface 46*a* to the disk surface 46*b* and are located near the center of the connector 44.

When the holes 66 in the receiver shaft 20 register with the holes 68 in the connector 44, the connector 44 can be secured to the receiver shaft 20 by fastening or connecting elements 70 such as screws which are inserted in the holes 66,68.

The flange 60 of the stub shaft 34 is formed with a series of holes 72 which are situated proximate to the periphery of the flange 60 and pass through the latter. The connector 44 is provided with a series of holes 74 which are adapted to register with selected ones of the holes 72 when the tapered pin 56 of the connector 44 is received in the tapered bore 62 of the stub shaft 34 and the keys 58 of the connector 44 are received in the keyway 64 of the stub shaft 34. The holes 74 in the connector 44 run from the disk surface 46*a* to the disk surface 46*b* and are disposed proximate to the periphery of the connector 44.

When the holes 72 in the stub shaft 34 register with the holes 74 in the connector 44, the connector 44 can be fastened to the stub shaft 34 by fastening or connecting elements 76 such as screws which are introduced into the holes 72,74.

Thrust loads between the receiver shaft 20 and the stub shaft 34 are transferred through the fastening elements 70 attaching the connector 44 to the receiver shaft 20 and through the fastening elements 76 attaching the connector 44 to the stub shaft 34.

Referring to FIGS. 2–4, the pedestal 16 is provided with three arms or beams 78 which are generally parallel to the axis of the receiver shaft 20. The arms 78 have respective end portions which are arranged to face the wet end 14, and each of these end portions is rabbeted to produce a step with an arcuate alignment surface 80. A passage 82 extends through each of the arms 78 parallel to the axis of the receiver shaft 20.

The legs 42 of the wet end 14 have respective end portions which are adapted to face the power frame 12, and each of these end portions is again rabbeted to form an arcuate lip 84. The lips 84 have the same curvature as, and are complementary to, the alignment surfaces 80 of the pedestal arms 78. Each of the legs 42 has a blind bore 86 which is parallel to the axis of the stub shaft 34 and opens to the respective rabbeted end portion.

In the assembled condition of the pump 10, the rabbeted end portions of the arms 78 abut respective ones of the rabbeted end portions of the legs 42. The lips 84 of the legs 42 bear against the respective alignment surfaces 80 of the arms 78 to produce a rabbet fit and the blind bore 86 in each leg 42 registers with the passage 82 in the abutting arm 78. The alignment surfaces 80 of the arms 78 and the lips 84 of the legs 42 function to properly position the power frame 12 and the wet end 14 relative to one another. Non-illustrated fasteners passing through the passages 82 of the arms 78 into the blind bores 86 of the legs 42 establish connections between the arms 78 and the legs 42.

Assuming that the power frame 12 and the wet end 14 of the pump 10 are separated as in FIG. 4 and that the connector 44 is disconnected from the power frame 12 and the wet end 14 as in FIGS. 2 and 5, one manner of assembling the pump 10 is as follows:

The connector 44 is oriented with the disk surface 46*a* facing the straight hole 52 and keyway 54 in the receiver shaft 20. The straight pin 48 on the disk surface 46*a* is inserted in the straight hole 52 while the keys 50 on the disk surface 46*a* are inserted in the keyway 54 thereby bringing the holes 68 in the connector 44 into register with the holes 66 in the receiver shaft 20. The fastening elements 70 are thereupon introduced into the registering holes 66,68 to attach the connector 44 to the receiver shaft 20 and the power frame 12.

The wet end 14, which constitutes a module including the casing 22, the impeller 28, the wear ring 32, the stub shaft 34, the sleeve assembly 36 and the adapter 40, is positioned with the legs 42 of the adapter 40 facing the power frame 12. The wet end 14 is then placed against the power frame 12 so that the tapered pin 56 on the disk surface 46*b* of the connector 44 is received by the tapered hole 62 in the stub shaft 34 and the keys 58 on the disk surface 46*b* are received by the keyway 64 in the stub shaft 34. Moreover, the legs 42 of the wet end 14 abut the arms 78 of the power frame 12 in such a manner that the lips 84 of the legs 42 bear against the alignment surfaces 80 of the arms 78. The holes 74 in the connector 44 now register with selected ones of the holes 72 in the stub shaft 34 while the passages 82 in the arms 78 register with the blind bores 86 in the legs 42. The stub shaft 34 is thereupon secured to the connector 44 by inserting the fastening elements 76 in the registering holes 72,74 of the stub shaft 34 and the connector 44. Similarly, non-illustrated fasteners are introduced into the passages 82 of the arms 78 and the blind bores 86 of the legs 42 to connect the arms 78 and the legs 42 to one another.

When the wet end 14 is not connected to the power frame 12, the impeller 28 is held in place mostly by the packing box 38. However, the packing box 38 gives little support to the impeller 28 so that the latter tends to become severely misaligned.

In order to inhibit misalignment of the impeller 28 when the wet end 14 is disconnected from the power frame 12, additional support for the impeller 28 can be provided.

Figure 6:
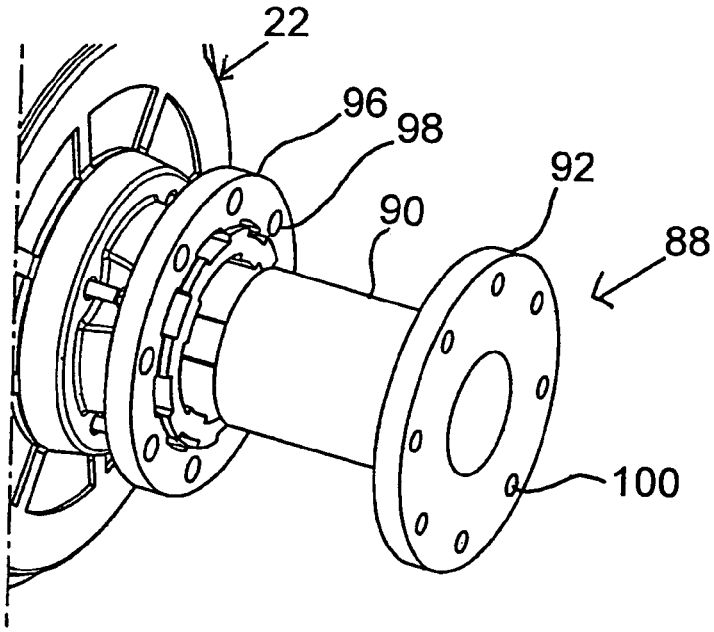
FIG. 6 is a fragmentary perspective view showing a suction port which constitutes part of the wet end and further showing a retainer for an impeller forming part of the wet end.
Figure 7:
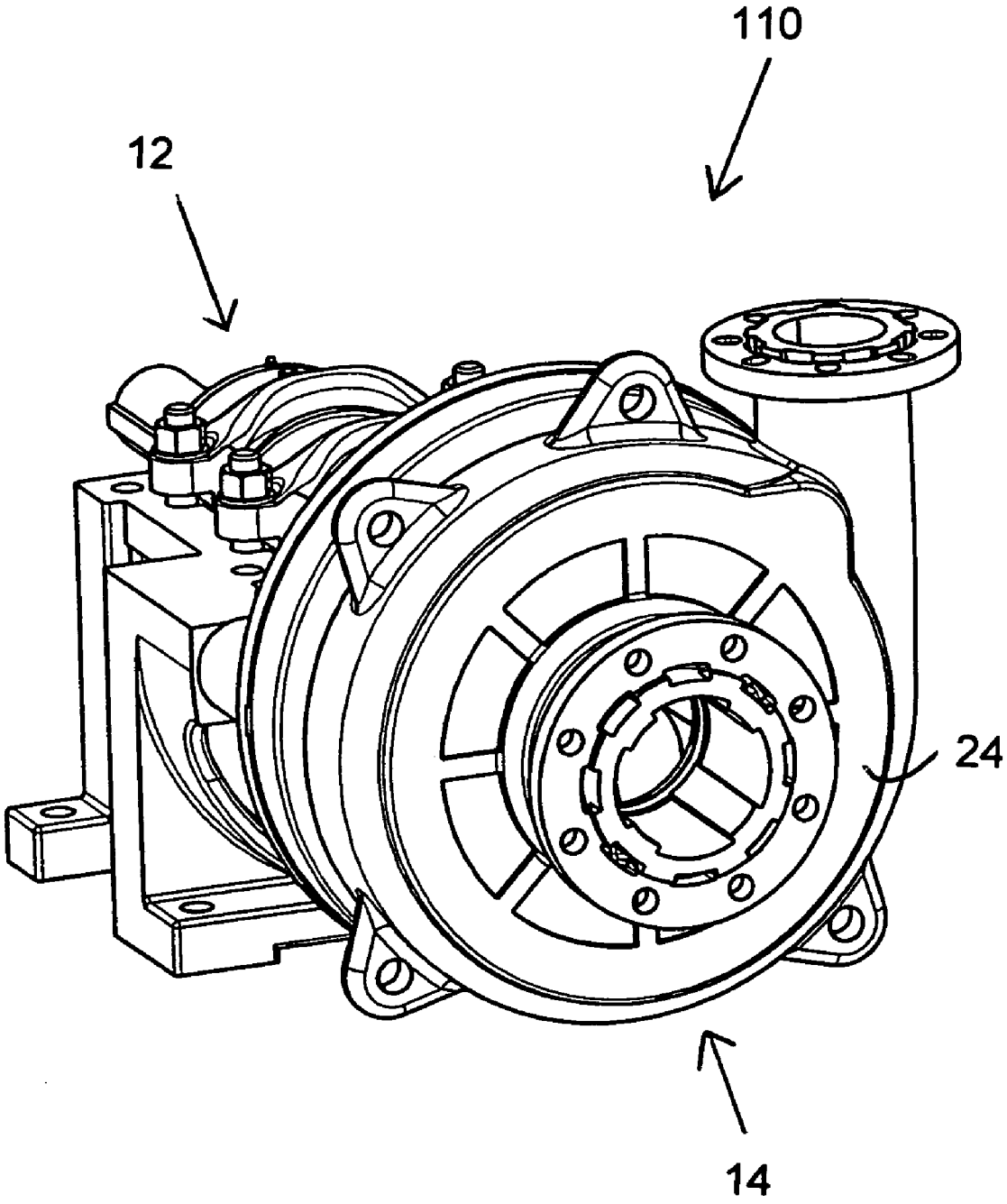
FIG. 7 is a perspective view of another, very massive, pump constructed according to the invention and having a power frame as well as a wet end.
Figure 8:
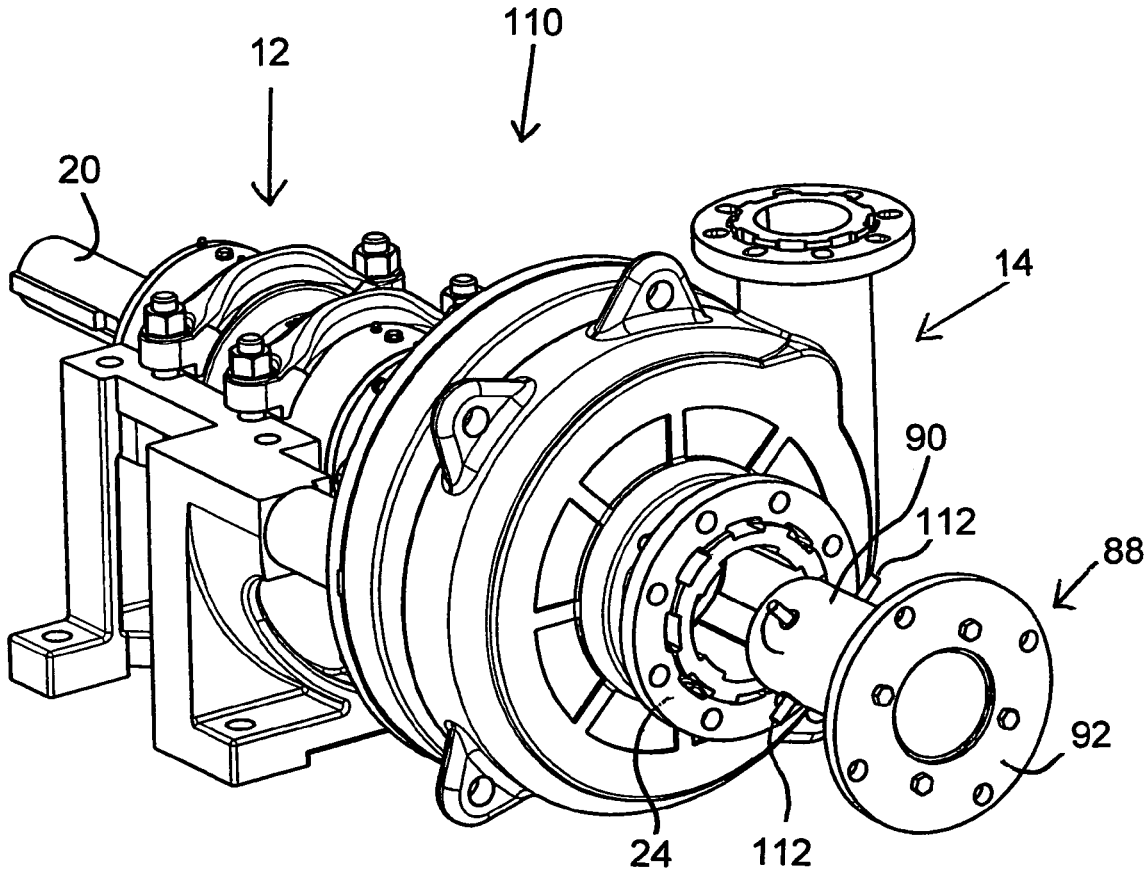
FIG. 8 is another perspective view of the pump of FIG. 7 showing a modified arresting member adapted to support in alignment the suction side of a large pump.
Figure 9:
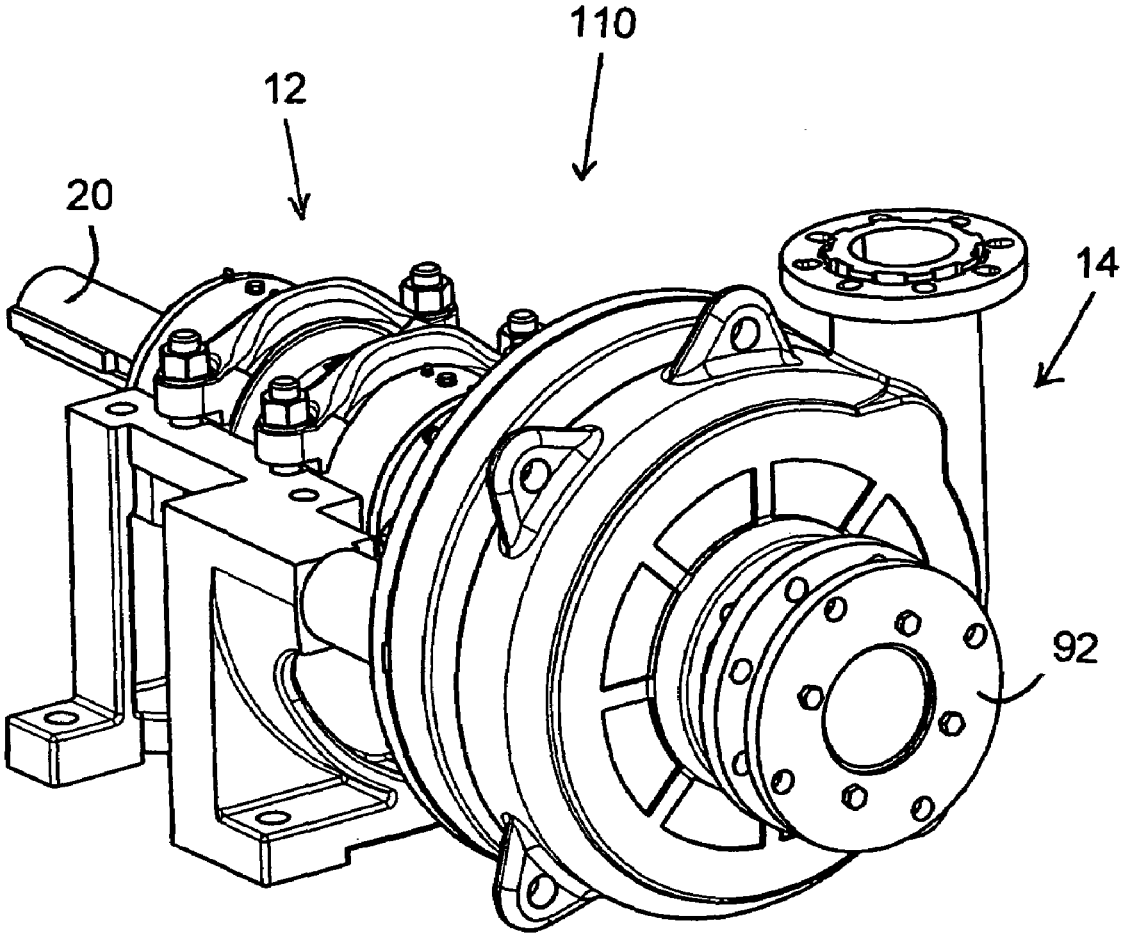
FIG. 9 shows the arresting member of FIG. 8 in place within the suction port of the pump.

Considering FIGS. 1, 3 and 6, the numeral 88 identifies a retainer or arresting member which is designed to arrest and support the impeller 28. The retainer 88 here comprises a pipe 90 which is adapted to be received in the suction port 24 and wear ring 32 of the wet end 14 with a small amount of clearance. One end of the pipe 90 is formed with a flange 92.

As seen in FIG. 3, the impeller 28 defines a recess 94 which faces the suction port 24 and has an opening adjacent to the wear ring 32. The size of the opening slightly exceeds the size of the pipe 90 so that the pipe 90 can enter the recess 94. Inward of the opening of the recess 94, the recess 94 narrows in a direction away from the suction port 24. Due to this narrowing, the end of the pipe 90 remote from the pipe flange 92 can come to bear against the impeller 28 upon insertion of the pipe 90 in the suction port 24. This allows the pipe 90 to immobilize and support the impeller 28.

The suction port 24 has an end portion which is located externally of the casing 22, and this end portion of the suction port 24 is formed with a flange 96. When the pipe 90 extends into the suction port 24 and bears against the impeller 28, the flange 92 of the pipe 90 is situated adjacent to the flange 96 of the suction port 24.

Referring to FIG. 6, the flange 96 of the suction port 24 has a series of holes 98 which pass through the flange 96 while the flange 92 of the pipe 90 has a series of holes 100 which pass through the flange 92. Each of the holes 98 is able to register with a respective hole 100 once the pipe 90 is positioned in the suction port 24 and the impeller 28 thereby allowing the retainer 88 to be secured to the casing 22 via non-illustrated fasteners such as bolts inserted in the registering holes 98,100.

After the wet end 14 has been attached to the power frame 12 as described above, the flange 96 of the suction port 24 and the flange 92 of the retainer 88 are disconnected from each other. The pipe 90 is thereupon withdrawn from the suction port 24. Following withdrawal of the pipe 90 from the suction port 24, a final adjustment of the clearance between the impeller 28 and the wear ring 32 is performed. The pump 10 is then ready for operation.

To detach the wet end 14 from the power frame 12, the pipe 90 is inserted in the suction port 24 and the impeller 28. Once the pipe 90 has been properly positioned, the flange 92 of the pipe 90 is connected to the flange 96 of the suction port 24.

The fasteners attaching the arms 78 of the power frame 12 to the legs 42 of the wet end 14 are removed as are the fastening elements securing the stub shaft 34 to the connector 44. The wet end 14 is now withdrawn from the power frame 12 as a module including the casing 22, the impeller 28, the wear ring 32, the stub shaft 34, the sleeve assembly 36 and the adapter 40.

The retainer 88 permits the wet end 14 to be disconnected from the power frame 12 and transported without severe misalignment of the impeller 28. Thus, the retainer 88 functions to hold the impeller 28 in place.

The invention makes it possible to achieve a quick release of the components of the wet end 14, including the casing 22, the impeller 28, the wear ring 32, the stub shaft 34, the sleeve assembly 36 and the adapter 40, as a pre-assembled single module. This allows a quick change-out of the wet end components to be achieved thereby enabling downtime, maintenance costs and scrap rate to be reduced. For instance, the downtime for replacement of the wet end of a large pump can be decreased to about 2 hours.

The wet end 14 may be used for a wide variety of the pumps on the market. By way of example, the diameter of the impeller 28 can range from 9 inches to 64 inches while the diameter of the casing 22 can range from 12 inches to 9 feet. This corresponds to pump sizes ranging from 3×2×9 to 28×26×64. Pumps in this size range include a 6×4×16 pump with MMB power frame and a 14×12×36 pump with MMD power frame. The wet end 14 can also be employed with other power frames such as a GIW® power frame or a millMAX power frame.

FIGS. 7–12 illustrate the concept of the invention implemented in a very large and massive pump 110 that requires special equipment and caution in the process of disassembly and reassembly of the power frame and wet end 12, 14. As in the case of the smaller pump 10 illustrated in FIGS. 1–6, the numeral 88 identifies a retainer or arresting member which is designed to support the impeller 28 (see FIG. 8). The retainer 88 here comprises a pipe 90 which is adapted to be received in the suction port 24 and wear ring 32 of the wet end 14 with a small amount of clearance. One end of the pipe 90 is formed with the flange 92. In addition, four jacking screws 112 located near the other end of the pipe 90 are used to bear against the blades of the impeller 28 and support the impeller in axial alignment with the wet end casing after the wet end 14 is separated from the power frame 14. During the process of disassembly, the impeller is moved axially away from the suction end 24 of the casing until it contacts the backliner 114 (FIG. 3). The retainer 88 is inserted into the casing inlet until it contacts the impeller back shroud and it is clamped in place with fasteners through holes 98 and 100. The jacking screws 112 are then adjusted from inside the pipe 90 until they but against the sloped suction portion of the impeller 28, thus holding it in place when the stub shaft 34 is disconnected from the connector 44.

Figure 10:
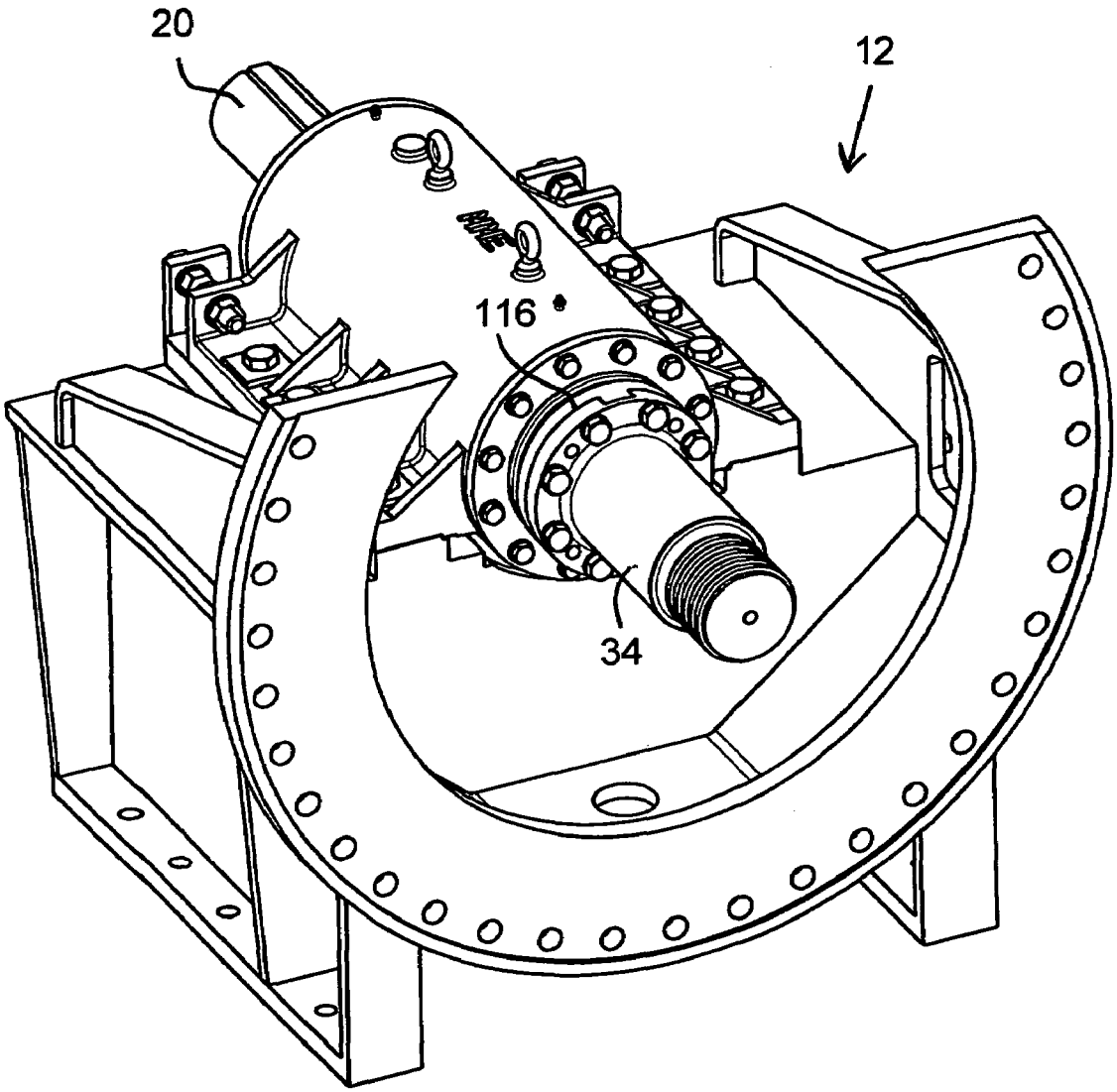
FIG. 10 is a cut-out of the pump of FIG. 7 showing the stub shaft connected directly to the receiver shaft.
Figure 11:
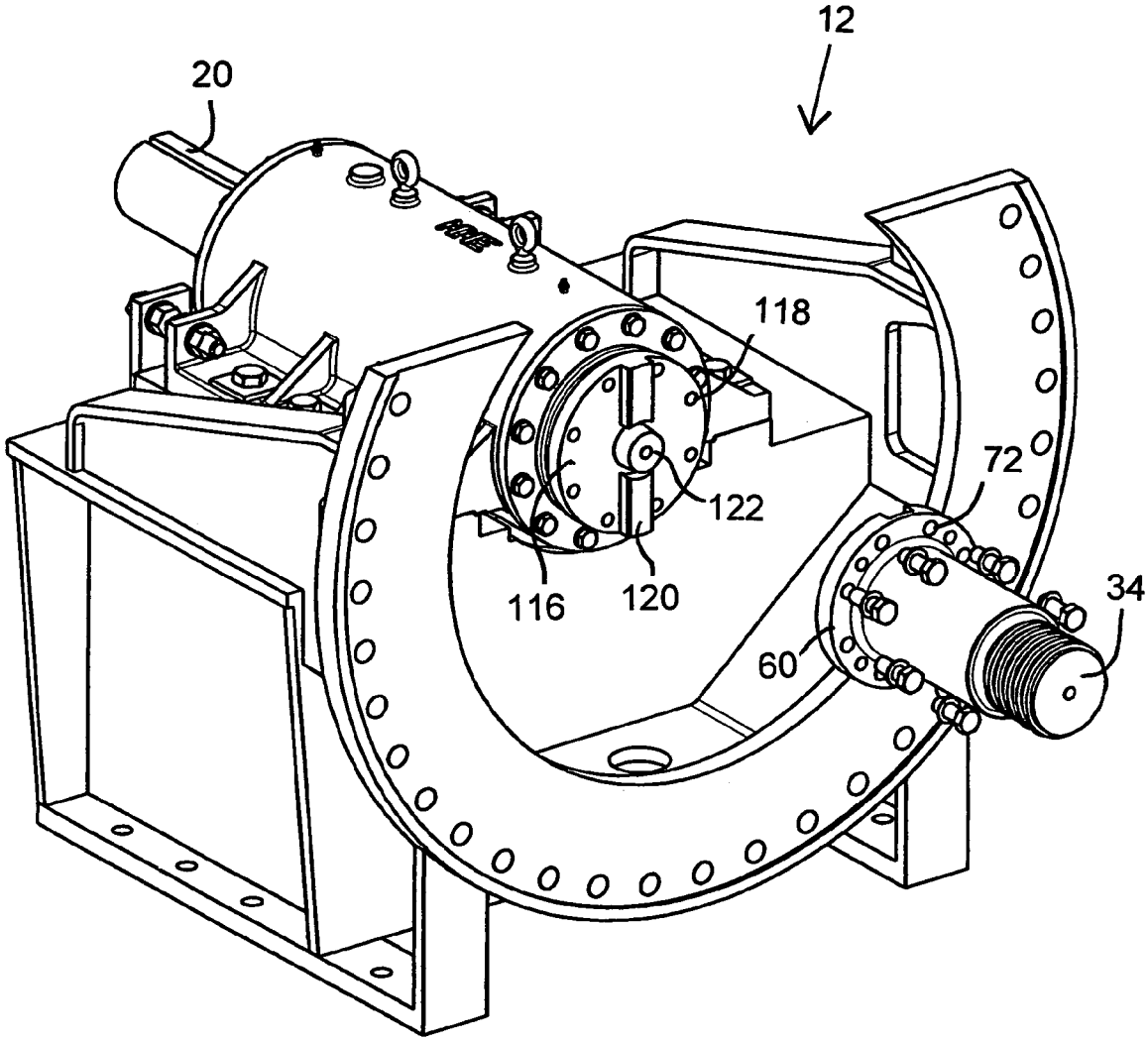
FIG. 11 is a view similar to that of FIG. 10 as seen from the wet end side and showing the stub shaft disconnected from the receiver shaft in the power frame of the pump.
Figure 12:
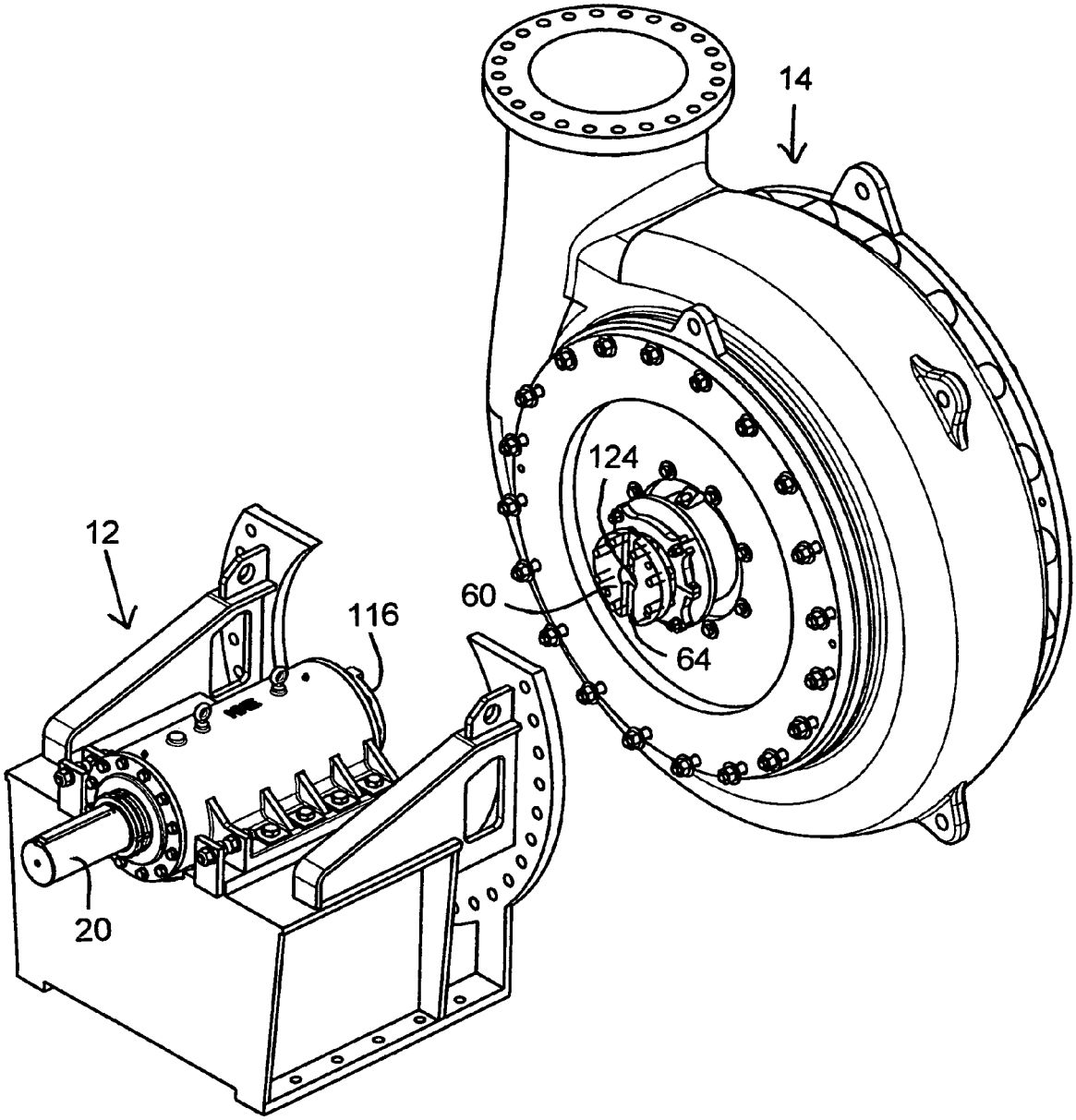
FIG. 12 is a view similar to that of FIG. 10 as seen from the power frame side and showing the disconnected stub shaft protruding from the wet end of the pump.

It is noted that on larger pump sizes the connector 44 is preferably not used in order to minimize the number of components in the drive train of the pump, as shown in FIGS. 10–12. The forward portion of the receiver shaft 20 includes a flange 116 with tapped holes 118, keys 120, and a tapered pin 122 conforming, respectively, to the holes 72, the keyway 64, and a tapered alignment hole 124 in the flange 60 of the stub shaft 34. Other than for the addition of the alignment hole 124, the stub shaft 34 is configured the same as shown in FIGS. 2 and 5 for the smaller pump sizes. Thus, as a result of the removal of the connector 44, an extra connection point that may compromise the strength and geometric relationship of the shaft assembly is eliminated.

Various modifications are possible within the meaning and range of equivalence of the appended claims.

We claim:

1. A pump body comprising:

a drive section designed to be coupled to a motor, said drive section including a support and a drive member mounted on said support;

a driven section including a housing and a pumping member in said housing arranged to be driven by said drive member, said driven section being attachable to and detachable from said drive section as a module; and a transmitting member for transferring force from said drive section to said driven section, said transmitting member and said drive section being provided with cooperating first coupling elements for establishing a drive connection between said transmitting member and said drive section, and said transmitting member and said driven section being provided with cooperating second coupling elements for establishing a drive connection between said transmitting member and said driven section.

2. The pump body of claim 1, wherein said driven section further comprises an additional driven member arranged to be coupled to said drive member and to said pumping member.

3. The pump body of claim 1, wherein said driven section and said transmitting member are provided with cooperating alignment elements for aligning said driven section and said transmitting member, said alignment elements being discrete from said coupling elements.

4. The pump body of claim 3, wherein said drive section and said transmitting member are provided with additional cooperating alignment elements for aligning said drive section and said transmitting member, said additional alignment elements being discrete from said coupling elements.

5. The pump body of claim 1, further comprising an arresting member for arresting said pumping member.

6. The pump body of claim 5, wherein said arresting member is discrete from said drive section and said driven section.

7. The pump body of claim 5, wherein said arresting member is insertable in and removable from said driven section, said arresting member and said driven section being provided with means for securing said arresting member to said driven section.

8. The pump body of claim 5, wherein said housing is provided with a fluid inlet port and a fluid outlet port, said arresting member being designed to engage and arrest said pumping member by inserting said arresting member in said driven section through one of said ports.

9. The pump body of claim 1, wherein said transmitting member is provided with first openings for first securing elements designed to secure said transmitting member and said drive section to one another, said transmitting member additionally being provided with second openings for securing elements designed to secure said transmitting member and said driven section to one another, and said openings being discrete from said coupling elements.

10. The pump body of claim 5, wherein said pumping member is provided with a recess which is at least partially bounded by a peripheral surface, said arresting member being designed to abut said peripheral surface so as to support said pumping member.

11. The pump body of claim 10, wherein said recess extends from an exterior location of said pumping member to an interior location of said pumping member, said recess narrowing in a direction from said exterior location towards said interior location.

12. A member for transmitting force from a drive section to a driven section of a pump body comprising:

a carrier having two surfaces portions;

first coupling means on one of said surface portions for establishing a drive connection between said carrier and the drive section of the pump body;

second coupling means on the other of said surface portions for establishing a drive connection between said carrier and the driven section of the pump body;

first alignment means on said one surface portion for aligning said carrier and the drive section of the pump body; and second alignment means on said other surface portion for aligning said carrier and the driven section of the pump body, said alignment means being discrete from said coupling means.

13. The member of claim 12, wherein said second alignment means comprises a tapered pin.

14. The member of claim 12, wherein said carrier is provided with openings for securing elements designed to secure the drive section of the pump body and the driven section of the pump body to one another, said openings being discrete from said coupling means.

15. The member of claim 12, wherein said carrier comprises a substantially circular disk.

16. The member of claim 12, wherein said carrier is provided with first openings for first securing elements designed to secure said carrier and the drive section of the pump body to one another, said carrier additionally being provided with second openings for second securing elements designed to secure said carrier and the driven section of the pump body to one another, and said openings being discrete from said coupling means and from said alignment means.

17. A method of handling a pump body having a drive section designed to be counted to a motor and a driven section attached to said drive section, said driven section including a housing and a pumping member in said housing arranged to be driven by said drive section, and said method comprising the steps of detaching said driven section from said drive section as a module and arresting said pumping member; wherein said pumping member is provided with a recess which is at least partially bounded by a peripheral surface, the arresting step comprising inserting an arresting member in said recess so that said arresting member abuts said peripheral surface to support said pumping member.

18. The method of claim 17, further comprising the step of reattaching said driven section to said drive section as a module, the reattaching step including interposing a force-transmitting member between said drive section and said driven section, and establishing a drive connection between said drive section and said driven section through said force-transmitting member.

19. A method of handling a pump body having a drive section designed to be coupled to a motor and a driven section attached to said drive section, said driven section including a housing and a pumping member in said housing arranged to be driven by said drive section, and said method comprising the step of detaching said driven section from said drive section as a module, and the step of reattaching said driven section to said drive section as a module, the reattaching step including interposing a force-transmitting member between said drive section and said driven section, aligning said force-transmitting member and said drive section using cooperating first alignment elements on said force-transmitting member and said drive section, aligning said force-transmitting member and said driven section using cooperating second alignment elements on said force-transmitting member and said driven section, engaging cooperating first coupling elements on said force-transmitting member and said drive section to establish a drive connection between said force-transmitting member and said drive section, and engaging cooperating second coupling elements on said force-transmitting member aid said driven section to establish a drive connection between said force-transmitting member and said driven section, said coupling elements being discrete from said alignment elements.

20. The method of claim 19, further comprising the step of arresting said pumping member.

21. The method of claim 20, wherein the arresting step comprises inserting an arresting member in said driven section; and further comprising the step of securing said arresting member to said driven section.

22. The method of claim 20, wherein said housing is provided with a fluid inlet port and a fluid outlet port, the arresting step including inserting an arresting member in said driven section through one of said ports.

23. A method of handling a pump body having a drive section designed to be coupled to a motor and a driven section attached to said drive section, said driven section including a housing and a pumping member in said housing arranged to be driven by said drive section, and said method comprising the step of detaching said driven section from said drive section as a module, and the step of reattaching said driven section to said drive section as a module, the reattaching step including interposing a force-transmitting member between said drive section and said driven section, securing said force-transmitting member to said drive section using first securing elements, and securing said force-transmitting member to said driven section using second securing elements discrete from said first securing elements.

* * * * *

UNITED STATES PATENT AND TRADEMARK OFFICE

CERTIFICATE OF CORRECTION

PATENT NO. : 7,074,017 B2
APPLICATION NO. : 10/969535
DATED : July 11, 2006
INVENTOR(S) : Dale E. Coray and Richard M. McGahee It is certified that error appears in the above-identified patent and that said Letters Patent is hereby corrected as shown below:

Column 9, line 40, change the word “counted” to --coupled--;

Column 10, line 24, change the word “aid” to --and--.

Signed and Sealed this

Twelfth Day of December, 2006

JON W. DUDAS
*Director of the United States Patent and Trademark Office*